US006374631B1

(12) United States Patent
Lifson et al.

(10) Patent No.: US 6,374,631 B1
(45) Date of Patent: Apr. 23, 2002

(54) ECONOMIZER CIRCUIT ENHANCEMENT

(75) Inventors: Alex Lifson, Manlius, NY (US); Boris Karpman, Marlborough, CT (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/536,121

(22) Filed: Mar. 27, 2000

(51) Int. Cl.[7] ..... F25B 5/00; F25B 31/00
(52) U.S. Cl. ..... 62/505; 62/117; 62/513
(58) Field of Search ..... 62/199, 200, 113, 62/513, 222, 223, 224, 225, 505, 117

(56) References Cited

U.S. PATENT DOCUMENTS 4,316,366 A * 2/1982 Manning ..... 62/200
4,523,436 A * 6/1985 Schedel et al. ..... 62/222
4,696,168 A * 9/1987 Woods et al. ..... 62/200
5,079,930 A * 1/1992 Beaverson et al. ..... 62/513 X
5,979,780 A * 11/1999 Malone et al. ..... 62/225

* cited by examiner

*Primary Examiner*—William Wayner
(74) *Attorney, Agent, or Firm*—Carlson, Gaskey & Olds

(57) ABSTRACT

An optimized position for an economizer shut-off valve, or other method of increasing the volume in an economizer line is disclosed In one embodiment, the economizer shut-off valve is positioned directly downstream of the economizer heat exchanger. In a second embodiment, the valve is positioned upstream of the economizer expansion valve and the economizer heat exchanger. In a third embodiment, the economizer expansion valve is also provided with an appropriate control such that it can be utilized as the shut-off valve. In the fourth embodiment, additional volume is added to the economizer line. With each of these embodiments, the volume of the economizer line between the compressor and the economizer shut-off valve is relatively large compared to the prior art. Benefits with regard to temperature control, efficiency and capacity increase are achieved by this invention. Moreover, a less expensive shut-off valve can be utilized.

27 Claims, 1 Drawing Sheet

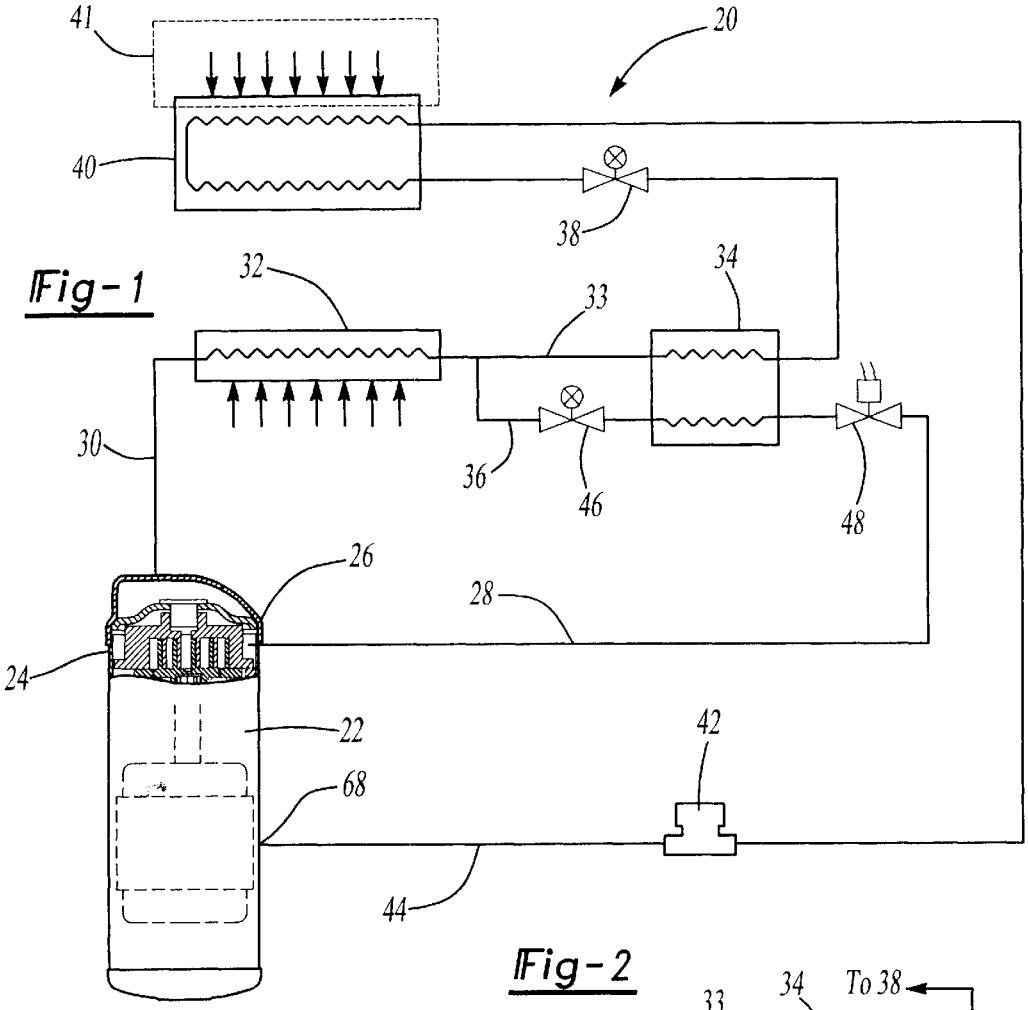
Fig-1
Fig-2
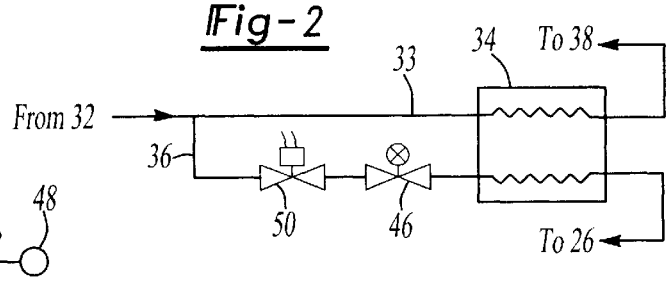
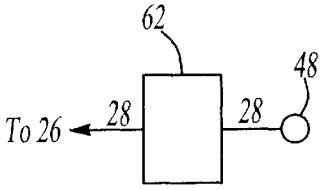
Fig-4
Fig-3
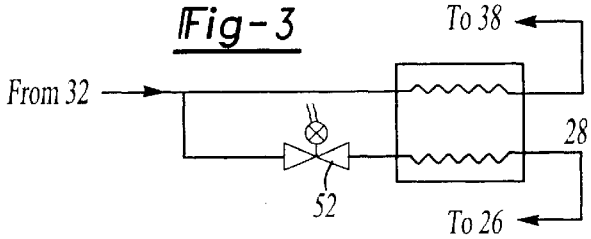
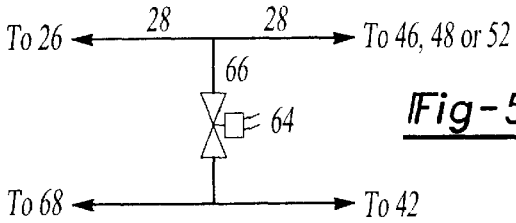
Fig-5

ECONOMIZER CIRCUIT ENHANCEMENT

BACKGROUND OF THE INVENTION

This invention relates to locating the economizer valve close to the economizer heat exchanger or otherwise increasing the volume of the economizer circuit line in a refrigeration cycle.

Economizer circuits are utilized in refrigeration cycles to provide increased cooling or heating capacity. As is known, a refrigeration cycle passes a refrigerant between a compressor, where it is compressed and to a condensor, where it is typically exposed to ambient air. From the condensor, the refrigerant passes through a primary expansion device and then to an evaporator. An environment to be cooled is cooled by the refrigerant passing through the evaporator. The refrigerant returns from the evaporator back to the compressor, and may pass through a suction throttling device on the way.

An economizer circuit is sometimes incorporated just downstream of the condensor. Essentially, a portion of the refrigerant leaving the condensor is tapped from the main flow line and passed through an economizer expansion device. An economizer heat exchanger or flash tank receives the fluid leaving the economizer expansion device, and further receives the main flow of refrigerant from the condensor before it enters the primary expansion device. A flash tank and an economizer heat exchanger are both known ways of transferring heat between two flow lines. For purposes of this application, the term "economizer heat exchanger" should be understood to include both a heat exchanger transferring heat between the two lines through pipes, or a flash tank. Both are heat exchangers used in economizer cycles, and both are known. The term "economizer heat exchanger" as utilized in this application and claims should thus be understood to include both. The refrigerant leaving the iconomizer, circuit expansion device cools the refrigerant in the main flow line prior to it reaching the primary expansion device. Thus, the refrigerant reaching the primary expansion device has been additionally precooled, and greater cooling capacity of the evaporator is achieved.

The tapped refrigerant leaving the economizer expansion device passes through the economizer heat exchanger and is returned to the compressor. To control cooling or heating unit capacity, it is desirable to have the capability of turning the economizer circuit on or off. Thus, a shut-off economizer valve is typically positioned adjacent to the compressor. An economizer line connects this shut-off valve back to the economizer heat exchanger. A further portion of the economizer line extends through the short distance from the economizer shut-off valve to the compressor.

During operation of the compressor, when the economizer valve is closed, the economizer portion of the line dead ends at the valve. Thus compressed refrigerant is pumped back and forth between the closed valve and the compressor in the dead end portion of the economizer line. This has sometimes resulted in undesirable temperature rise in the economizer line. Due to the high temperatures, expensive shut-off valves capable of withstanding the high temperatures may have been required.

The present invention is directed to optimizing the position of the economizer shut-off valve, which has previously been positioned adjacent the compressor, or otherwise adding additional volume between the compressor and shut-off valve.

SUMMARY OF THE INVENTION

In a disclosed embodiment of this invention, the economizer shut-off valve is positioned closer to the economizer heat exchanger than it is to the compressor spaced from the compressor or additional volume is otherwise added into the economizer line. Thus, there is a relatively long or large volume economizer dead end portion between the shut-off valve and the compressor when the shut-off valve is closed.

In a most preferred embodiment, the shut-off valve is positioned directly adjacent to the economizer heat exchanger. Thus, it is preferred that the economizer shut-off valve be positioned within the 50% of the economizer line closest to the economizer heat exchanger. It is most preferred that the economizer shut-off valve be positioned in the line within 20% of the economizer heat exchanger in embodiments wherein the economizer shut-off valve is positioned downstream of the economizer heat exchanger. Stated another way, additional volume is added to the portion of the economizer line extending toward the compressor.

In other embodiments, the economizer shut-off valve is positioned upstream of the economizer expansion device.

Further, in yet another embodiment, the economizer expansion device is electronically controlled and utilized not only as the expansion device but also as a shut-off valve.

With each of the above-discussed embodiments, the length and/or volume of the dead end portion of the economizer line is greatly increased compared to the prior art. While one might expect that such a positioning could result in decreased efficiency or capacity, in fact, the reverse has proven true. Tests show that with the positioning of the economizer shut-off valve closer to the economizer heat exchanger, both compressor efficiency and capacity are increased. Further, because the efficiency of the compression process is increased, the discharge temperature of the refrigerant leaving the compressor is also reduced by a few degrees.

The temperature in the dead end portion of the economizer line is significantly reduced. In one test, the temperature was reduced from a high of 310° F. to 200° F. This allows the use of less expensive shut-off valves, which need not withstand the high temperatures of the prior art. Further, fire hazards, etc., are minimized.

If the economizer shut-off valve is positioned upstream of the expansion device, the valve will typically seal the liquid portion of the refrigerant. The liquid lines are smaller in diameter than vapor lines and are easier to seal, thus, an even less expensive valve can be utilized, as a valve to seal liquid can be smaller and less expensive than a vapor line valve.

These and other features of the present invention can be best understood from the following specification and drawings, the following of which is a brief description.

BRIEF DESCRIPTION OF THE DRAWINGS

FIG. 1 shows a first embodiment of this invention.

FIG. 2 shows a second embodiment.

FIG. 3 shows a third embodiment.

FIG. 4 shows a fourth embodiment.

FIG. 5 shows a configuration where all of the above embodiments can be considered in conjunction with the use of a by-pass valve placed between the economizer and suction line.

DETAILED DESCRIPTION OF THE PREFERRED EMBODIMENTS

A refrigeration cycle 20 is illustrated in FIG. 1 having a compressor 22 incorporating compressor pump unit 24, shown as a scroll compressor. As shown, vapor from an economizer injection line 28 is injected through an economizer injection port 26 into compression chambers defined by the pump unit 24. An economizer line 28 is defined extending from the compressor back toward the economizer heat exchanger, which will be described in greater detail below. A discharge line 30 leaves from compressor 22 to the condenser 32. From the condensor 32 a main refrigerant flow line 33 passes through an economizer heat exchanger 34. Again, the economizer heat exchanger 34 can also be provided by a flash tank. An economizer tap 36 leads through the heat exchanger 34. Again, the economizer cycle will be described in greater detail below. Downstream of the heat exchanger 34 is a primary expansion device 38, and an evaporator 40. As is known, an environment 41 to be cooled is cooled by refrigerant evaporating and further super heating in the evaporator 40. The present invention is preferably directed to refrigerated areas that need to be cooled to low temperatures., In the illustration the area is a refrigerated transport unit. With such systems, the distance of economizer circuit is relatively great. From the evaporator 40, the refrigerant may pass back through an optional suction throttling device 42, and to a line 44 returning to the compressor suction 68. One of the Applicants has recently proposed a system wherein an unloader bypass device connects the lines 28 and 44. However, the details of this unloader device are separate from this invention.

An economizer expansion device 46 is mounted on the tap line 36. An economizer shut-off valve 48 is positioned directly downstream of the heat exchanger 34. When the valve 48 is closed, the line 28 dead ends at the valve and the dead end portion of line 28 is relatively long compared to the prior art. It is preferred that the shut-off valve 48 is not positioned in the closest half of the dead end portion of line 28 toward the compressor 22. More preferably, the shut-off valve 48 is positioned in line 28 within 20% of its distance from the economizer heat exchanger 34 relative to the total distance between the heat exchanger 34 and the compressor 22. The present invention thus provides a very long length to the dead end portion 28, and benefits as described above are achieved. During operation, when no economizer operation is desired, the valve 48 is closed by a control, as known. Thus, the dead end portion 28 receives fluid from the compressor pump unit 24. During economized operation, the valve 48 is open, and refrigerant is injected back into the compressor pump unit 24 through the line 28.

FIG. 2 shows the second embodiment wherein the shut-off valve is positioned upstream of the economizer expansion valve 46. With this embodiment, a low cost valve 50 can be utilized as the valve will typically be sealing a liquid, rather than a vapor. A valve sealing liquid is relatively inexpensive as compared to a valve that is sealing a vapor.

In a third embodiment shown in FIG. 3, the economizer expansion device is an electronic expansion valve 52 that is electronically controlled such that it can also provide the shut-off function. Again, a low cost design is achieved due to the elimination of the extra valve.

In a fourth embodiment of this invention, a volume 62 is added into downstream portion of the line 28 to increase effectiveness in the use of dead ending line 28 when this line is closed off. The volume 62 is an integral part of line 28 and in the simplest case can be represented by a line whose diameter is larger than that of line 28. The use of volume 62 becomes especially important when the length of the dead ending portion of line 28 is limited by the dimensional envelope of the refrigeration cycle unit.

FIG. 5 shows a configuration where a by-pass valve 64 is added to the refrigeration cycle. All the above embodiments would also apply to this configuration and the line 66 extending to the by-pass valve would also be considered as part of the dead end volume.

In each of the above discussed embodiments, the length or the volume of the economizer line dead end portion 28 is greatly increased compared to the prior art. Benefits relating to efficiency, capacity, and discharge temperature are all achieved. Moreover, since the valve is operating in a lower temperature environment, a less expensive valve can be reliably used.

The increased volume of the dead end is preferably sufficient such that the refrigerant trapped forwardly of the shut-off valve and between the shut-off valve and the compressor is equal to at least 10% of the volumetric compressor capacity of the compressor. More preferably, the volume is more than 20% of the volumetric capacity of the compressor. The size of the space 62, which is preferably an enlarged space placed upon the fluid line 28 should be sized accordingly. Alternatively, or in combination, the valve should be positioned far enough away from the compressor that this volume is achieved. A refrigeration transport unit typically has a relatively long line 28 between the compressor 22 and the heat exchanger 34. The distance may be five to ten feet. In such systems it is desirable for the valve to be spaced from the compressor by at least one foot. Stated another way, the valve is preferably not in the first 10% to 20% of the length between the compressor and the heat exchanger. More preferably, and as shown in FIG. 1, the valve is positioned quite close to the heat exchanger.

Several embodiments of this invention have been disclosed, however, a worker in this art would recognize that many modifications would come within the scope of this invention. For that reason, the following claims should be studied to determine the true scope and content of this invention.

What is claimed is:

1. A refrigeration cycle comprising:

a compressor having a refrigerant main suction inlet and a discharge outlet;

a condensor communicating with said discharge outlet, said condensor passing refrigerant to an economizer tap, and to a main refrigerant flow line, said main refrigerant flow line leading to a primary expansion device, and said tap passing through an economizer expansion device;

an economizer heat exchanger positioned on said main flow line upstream of said primary expansion device, said tap also passing through said economizer heat exchanger, said economizer heat exchanger being positioned downstream of said economizer expansion device, said tap communicating with said main flow line upstream of said economizer heat exchanger;

an evaporator positioned downstream of said primary expansion device, and, refrigerant passing from said evaporator back to said compressor via the main suction inlet; and an economizer line passing from said economizer heat exchanger back to said compressor via a line entirely separate for the main suction inlet, and a shut-off valve for shutting off flow of refrigerant through said economizer line to said compressor, said shut-off valve being spaced from said compressor by a distance that is more than 10% of the length of said economizer line between said economizer heat exchanger and said compressor.

2. A refrigeration cycle as set forth in claim 1, wherein said shut-off valve is positioned upstream of said economizer heat exchanger.

3. A refrigeration cycle as recited in claim 2, wherein said shut-off valve is positioned upstream of said economizer expansion valve.

4. A refrigeration cycle as recited in claim 2, wherein said economize expansion valve is controllable to shut completely such that it provides said economizer shut-off valve.

5. A refrigeration cycle as recited in claim 1, wherein said compressor incorporates a scroll pump unit.

6. A refrigeration cycle as recited in claim 1, wherein an increased volume is provided by said economizer line having a non-constant cross-sectional area with an enlarged volume being provided by an increased volume portion.

7. A refrigeration cycle as recited in claim 6 wherein an enlarged chamber is provided on said economizer line.

8. A refrigeration cycle comprising:

a compressor having a refrigerant main suction inlet and a discharge outlet;

a condensor communicating with said discharge outlet, said condensor passing refrigerant to an economizer tap, and to a main refrigerant flow line, said main refrigerant flow line leading to a primary expansion device, and said tap passing through an economizer expansion device;

an economizer heat exchanger positioned on said main flow line upstream of said primary expansion device, said tap also passing through said economizer heat exchanger, said economizer heat exchanger being positioned downstream of said economizer expansion device;

an evaporator positioned downstream of said primary expansion device, and refrigerant passing from said evaporator back to said compressor via the main suction inlet;

an economizer line passing from said economizer heat exchanger back to said compressor via a line entirely separate from the main suction inlet, and a shut-off valve for shutting off flow of refrigerant through said economizer line to said compressor, said shut-off valve being spaced from said compressor by a distance that is more than 10% of the length of said economizer line between said economizer heat exchanger and said compressor; and said shut-off valve is positioned downstream of said economizer heat exchanger.

9. A refrigeration cycle as recited in claim 8, wherein said shut-off valve is positioned closer to said economizer heat exchanger than to said compressor.

10. A refrigeration cycle as recited in claim 9, wherein said economizer line does not have a constant cross-sectional area such that an additional volume of refrigerant is trapped between said shut-off valve and said compressor in an increased volume area.

11. A refrigeration cycle as recited in claim 9, wherein said shut-off valve is positioned within 20% of the overall length of said economizer line relative to said economizer heat exchanger.

12. A refrigerated transport container comprising:

compressor having a refrigerant main suction inlet and a discharge outlet;

a condensor communicating with said discharge outlet, said condenser passing refrigerant to an economizer tap, and to a main refrigerant flow line, said main refrigerant flow line leading to a primary expansion device, and said tap passing through an economizer expansion device;

an economizer heat exchanger positioned on said main flow line upstream of said primary expansion device said tap also passing through said economizer heat exchanger, said economizer heat exchanger being positioned downstream of said economizer expansion device, said tap communicating with said main flow line, upstream of said economized heat exchanger;

an evaporator positioned downstream of said primary expansion device, and refrigerant passing from said evaporator back to said compressor via the main suction inlet; an economizer line passing from said economizer heat exchanger back to said compressor, and shut-off valve for shutting off flow of refrigerant through said economizer line to said compressor, said shut-off valve being spaced from said compressor by a distance that is more than 10% of the length of said economizer between said economizer heat exchanger and said compressor;

said valve being spaced from said compressor by a distance that is more than 10% of the length of said economizer between said economizer heat exchanger and said compressor; and a refrigerated transport unit being cooled by said evaporator.

13. A container as recited in claim 12, wherein said economizer line does not have a constant cross-sectional area such that an additional volume of refrigerant is trapped between said shut-off valve and said compressor in an increased volume area.

14. A container as set forth in claim 12, wherein said shut-off valve is positioned upstream of said economizer heat exchanger.

15. A container as recited in claim 14, wherein said shut-off valve is positioned upstream of said economizer expansion valve.

16. A container as recited in claim 14, wherein said economizer expansion valve is also controllable to shut completely such that it provides said economizer shut-off valve.

17. A container as recited in claim 12, wherein said compressor incorporates a scroll pump unit.

18. A container as recited in claim 12, wherein said economizer line has an increased volume area with a flow cross-sectional area greater than a nominal flow cross-sectional area in said economizer line to increase a volume of refrigerant trapped between said shut-off valve and said compressor.

19. A refrigerated transport container comprising:

compressor having a refrigerant main suction inlet and a discharge outlet;

a condenser communicating with said discharge outlet, said condensor passing refrigerant to an economizer tap, and to a main refrigerant flow line, said main refrigerant flow line leading to a primary expansion device, and said tap passing through an economizer expansion device;

an economizer heat exchanger positioned on said main flow line upstream of said primary expansion device, said tap also passing through said economizer heat exchanger, said economizer heat exchanger being positioned downstream of said economizer expansion device;

an evaporator positioned downstream of said primary expansion device, and refrigerant passing from said evaporator back to said compressor via the main suction inlet; an economizer line passing from said economizer heat exchanger back to said compressor via a line entirely separate for the main suction inlet, and a shut-off valve for shutting off flow of refrigerant through said economizer line to said compressor, said shut-off valve being spaced from said compressor by a distance that is more than 10% of the length of said economizer between said economizer heat exchanger and said compressor;

said valve being spaced from said compressor by a distance that is more than 10% of the length of said economizer between said economizer heat exchanger and said compressor;

a refrigerated transport unit being cooled by said evaporator; and said shut-off valve is positioned downstream of said economizer heat exchanger.

20. A container as recited in claim 19, wherein said shut-off valve is positioned closer to said economizer heat exchanger than to said compressor.

21. A container as recited in claim 20, wherein said shut-off valve is positioned within 20% of the overall length of said economizer line relative to said economizer heat exchanger.

22. A refrigeration cycle comprising:

a compressor having a refrigerant suction inlet and a discharge outlet;

a condensor communicating with said discharge outlet, said condenser passing refrigerant to an economizer tap, and to a main refrigerant flow line, said main refrigerant flow line leading to a primary expansion device, and said tap passing through an economizer expansion device;

an economizer heat exchanger positioned on said main flow line upstream of said primary expansion device, said tap also passing through said economizer heat exchanger, said economizer heat exchanger being positioned downstream of said economizer expansion device;

an evaporator positioned downstream of said primary expansion device, and refrigerant passing from said evaporator back to said compressor; and an economizer line passing from said economizer heat exchanger back to said compressor, and a shut-off valve for shutting off flow of refrigerant through said economizer line to said compressor, said shut-off valve being positioned at a point in said cycle which results in volume of said economizer line between said shut-off valve and said compressor being grater than 10% of the volumetric capacity of the compressor, said increased volume being provided by an increased volume chamber on said economizer line having an enlarged cross-sectional area compared to a nominal cross-sectional area of said economizer line such that said volume of said economizer line between said shut-off valve and said compressor being greater than 10% of the volumetric capacity of the compressor.

23. A refrigeration cycle as recited in claim 22, wherein said increased volume is provided at least in part by a flow line extending to an unloader valve off of said economizer line.

24. A refrigeration cycle comprising:

a compressor having a refrigerant main suction inlet and a discharge outlet;

a condensor communicating with said discharge outlet, said condensor passing refrigerant to a tap, and to a main refrigerant flow line, said main refrigerant flow line leading to an expansion device, and said tap passing through an economizer expansion device;

an economizer heat exchanger positioned on said main flow line upstream of said main expansion device, and said tap also passing through said economizer heat exchanger, said economizer heat exchanger being positioned downstream of said economizer expansion device, an evaporator mounted downstream of said main expansion device, and refrigerant passing from said evaporator back to said compressor via the main suction inlet, said tap communicating with said main flow line upstream of said economizer heat exchanger; and an economizer line passing from said economizer heat exchanger back to said compressor via a line entirely separate form the main suction inlet, and a shut-off valve for shutting off flow of refrigerant through said economizer cycle to said compressor, said shut-off valve being positioned upstream of said economizer heat exchanger.

25. A refrigeration cycle as recited in claim 24, wherein said shut-off valve is positioned upstream of said economizer heat exchanger.

26. A refrigeration cycle as recited in claim 25, wherein said shut-off valve is positioned upstream of said economizer expansion valve.

27. A refrigeration cycle as recited in claim 24, wherein said economizer expansion valve is controllable to shut completely such that it provides said economizer shut-off valve.

* * * * *

UNITED STATES PATENT AND TRADEMARK OFFICE

CERTIFICATE OF CORRECTION

PATENT NO. : 6,374,631 B1
DATED : April 23, 2002
INVENTOR(S) : Lifson et al.

It is certified that error appears in the above-identified patent and that said Letters Patent is hereby corrected as shown below:

Column 5,
Line 5, “economize” should be -- economizer --

Column 7,
Line 48, “grater” should be -- greater --

Signed and Sealed this

Nineteenth Day of November, 2002

*Attest:*

*Attesting Officer*

JAMES E. ROGAN
*Director of the United States Patent and Trademark Office*